US005338052A

United States Patent [19]

Freisinger et al.

[11] Patent Number: 5,338,052

[45] Date of Patent: Aug. 16, 1994

[54] SAFETY SKI BINDING RELEASE AND RESET MECHANISM

[75] Inventors: Henry Freisinger; Heinz Wittmann, both of Vienna, Austria

[73] Assignee: HTM Sport - und Freizeitgeraete Aktiengesellschaft, Schwechat, Austria

[21] Appl. No.: 50,150

[22] PCT Filed: Aug. 21, 1992

[86] PCT No.: PCT/EP92/01917

§ 371 Date: Apr. 23, 1993

§ 102(e) Date: Apr. 23, 1993

[87] PCT Pub. No.: WO93/03804

PCT Pub. Date: Mar. 4, 1993

[30] Foreign Application Priority Data

Aug. 23, 1991 [AT] Austria ..... 1665/91

[51] Int. Cl.[5] ..... A63C 9/08

[52] U.S. Cl. ..... 280/612; 280/629

[58] Field of Search ..... 280/612, 613, 611, 625, 280/629, 634

[56] References Cited

U.S. PATENT DOCUMENTS

| | | | |
|---|---|---|---|
| 3,367,672 | 2/1968 | Tonozzi et al. | 280/612 |
| 3,820,803 | 6/1974 | Frisch et al. | 280/612 |
| 4,130,296 | 12/1978 | D'Antonio et al. | 280/612 |
| 4,460,195 | 7/1984 | Bildner | 280/612 |
| 4,589,672 | 5/1986 | Dimier et al. | 280/612 X |

*Primary Examiner*—Brian L. Johnson

*Attorney, Agent, or Firm*—Flynn, Thiel, Boutell & Tanis

[57] ABSTRACT

A safety ski binding release and reset mechanism having a housing, a releasable jaw mechanism mounted on the housing and having at least one sole holding member movable between a ski boot holding position and a ski boot releasing position and for releasably engaging a ski boot when in the ski boot holding position. A first spring is provided on the housing, the sole holding member being retained in the ski boot holding position by a two-part holding device. A first part of the two-part holding device is movable against an urging of a first spring supported on the housing and determining a holding force for holding the ski boot in the ski boot holding position. A second part of the two-part holding device engages the sole holding member. The first and second parts are releasably connected with one another by a rotatable coupling mechanism. The rotatable coupling mechanism includes a rotatable responsive device coupled to a reversible electric motor for effecting a release of the connection between the first and second parts in response to a movement of an output member of an electric motor to a first position. A second spring is provided for initially urging the sole holder to the ski boot holding position. The output member of the electric motor, when in the first position, causing the first spring to be rendered ineffective thereby reducing a force required to move the sole holding member to the ski boot releasing position.

8 Claims, 5 Drawing Sheets

SAFETY SKI BINDING RELEASE AND RESET MECHANISM

FIELD OF THE INVENTION

The invention relates to a safety ski binding release and reset mechanism comprising a releasable jaw in which at least one holding member engaging a ski boot to be held is supported in its holding position by a two-part holding part, on one part of which engages a spring determining the holding force and supported on one housing part, and a second part of which engages the holding part or holding parts, with these two parts being releasably connectable to one another through a coupling mechanism or rather being connectably locked against movement at least in a direction of the force action of the spring, which coupling mechanism is controlled by a feversably rotatable electric motor controlled by an evaluating circuit processing signals of at least one force-receiving means.

BACKGROUND OF THE INVENTION

Such a binding has, for example, become known from AT-PS 375 833. The coupling mechanism in this known solution has overlapping sections of the two parts of the holding part arranged coaxially to one another and coupling members, preferably balls, are arranged in the overlapping section and are held on the overlapped section by an inclined extending shoulder and openings, the size of which corresponds at least with the size of the coupling members. This overlapping section is surrounded by a sleeve which has on its inner wall at least one free area to receive the coupling members which, in the released position of the coupling mechanism, coincide with the openings of the overlapping section and can receive the coupling members. The sleeve itself is axially movable by an electric motor which is loaded by a circuit detecting the forces acting onto the binding.

In these bindings which operate essentially according to the so-called spring pliers principle, the force needed to move the sleeve can be relatively large when the binding is iced up and the force must be applied by the electric motor. Thus, it is necessary to design same suitably strong since the release, when needed, must occur very quickly.

SUMMARY OF THE INVENTION

The goal of the invention is to avoid these disadvantages and to provide a binding of the above-mentioned type in which a small electric motor requiring only little energy will be sufficient and yet assuming a high degree of safety in the release when the binding is iced. This is achieved with the invention in such a manner that the coupling mechanism is initially tensioned by a coupling spring to prevent movement toward its disengaged position, the disengaged position of the connection of the two parts of the holding part initially locked against movement, corresponding to the point whereat they are released.

With this measure it is possible to design the coupling spring relatively strong and to tension same after a release by the electric motor in order to engage the coupling mechanism. This can, however, be done relatively slowly, for example, within 10 to 20 seconds, so that a very small and weak electric motor, which can be stepped down accordingly, will be sufficient.

In a ski binding of the invention in which the coupling has overlapping sections of the two parts of the holding part, which two parts are arranged coaxially to one another in an area adjacent coupling members, preferably balls, which are arranged in the overlapping section and are held on the overlapped section by an inclined extending shoulder and openings the size of which corresponds at least with the size of the coupling member. The overlapping section is surrounded by a sleeve which has at least one free area on its inner wall to receive the coupling members which, in the released position of the coupling mechanism, cover the openings of the overlapping section and receive the coupling members. According to a further characteristic of the invention, a coupling spring is provided which engages the sleeve in a peripheral direction and further engages a pivotally held pawl part which cooperates with the sleeve, with the shaft of the electric motor being able to drivingly connect, if necessary through a transfer member, to the pawl part and the sleeve.

This results in a very simple design of the coupling mechanism. The sleeve, which is important for the creation or rather the release of a connection of the two parts of the holding part, which connection is locked against movement, can be supported easily in its engaged position loaded by the spring by the pawl part and can be released from this position over a short path of movement.

It can furthermore be provided that the transfer element and the pawl part are arranged on the shaft of the electric motor, with the first one being held non-rotatably and the last one being held rotatably.

A very simple and compact design is made possible with this measure.

According to a further characteristic of the invention, it can be provided that the pawl part is designed essentially L-shaped, with one leg thereof cooperating with a shoulder of the sleeve, which shoulder radially projects from the sleeve, or rather being able to rest on the shoulder, and the second leg, with the shaft of the electric motor rotating in a release direction, being able to engage an eccentric shoulder on the shaft or of the transfer element.

Thus, the sleeve can easily be operated and after an engaged position of the sleeve is reached, when the pawl part engages the corresponding shoulder of the sleeve, the transfer element can again be turned back.

Furthermore, a device monitoring certain positions of the shaft of the electric motor can be provided.

This makes it possible to permit the electric motor to run during the engagement of the coupling mechanism up to a certain position of the shaft, or rather of the transfer element, at which point a safe locking of the pawl part takes place, and to subsequently again turn the electric motor back in order to move its shaft or rather the transfer element into a position from which the pawl part can be quickly moved out of its locked position whereat it holds the sleeve in a position securing a connection of the two parts of the holding part.

The device provided for monitoring the position of the shaft can be position feelers which are arranged fixedly at specific points around the shaft and are connected to a corresponding evaluating circuit, or, however, also a stepping motor which is provided for the drive of the shaft controlling the transfer element, and a suitable control circuit with a counter counting the individual steps of the stepping motor, the outputs of which cause a corresponding reversing and stopping of the stepping motor. The position feelers are not needed in the latter case, thus also saving adjustment operations.

The transfer element can furthermore be designed essentially cam-like and can rest with the shaft of the electric motor rotating in engaging direction of the coupling arrangement on an arm of the sleeve projecting in a radial direction from the sleeve and to which is connected preferably the coupling spring to rotate through the arm of the sleeve against the force of the coupling spring.

A very simple design of the coupling mechanism is achieved in this manner.

BRIEF DESCRIPTION OF THE DRAWINGS

The invention will now be discussed in greater detail in connection with the drawings, in which.

DETAILED DESCRIPTION

Figure 1:
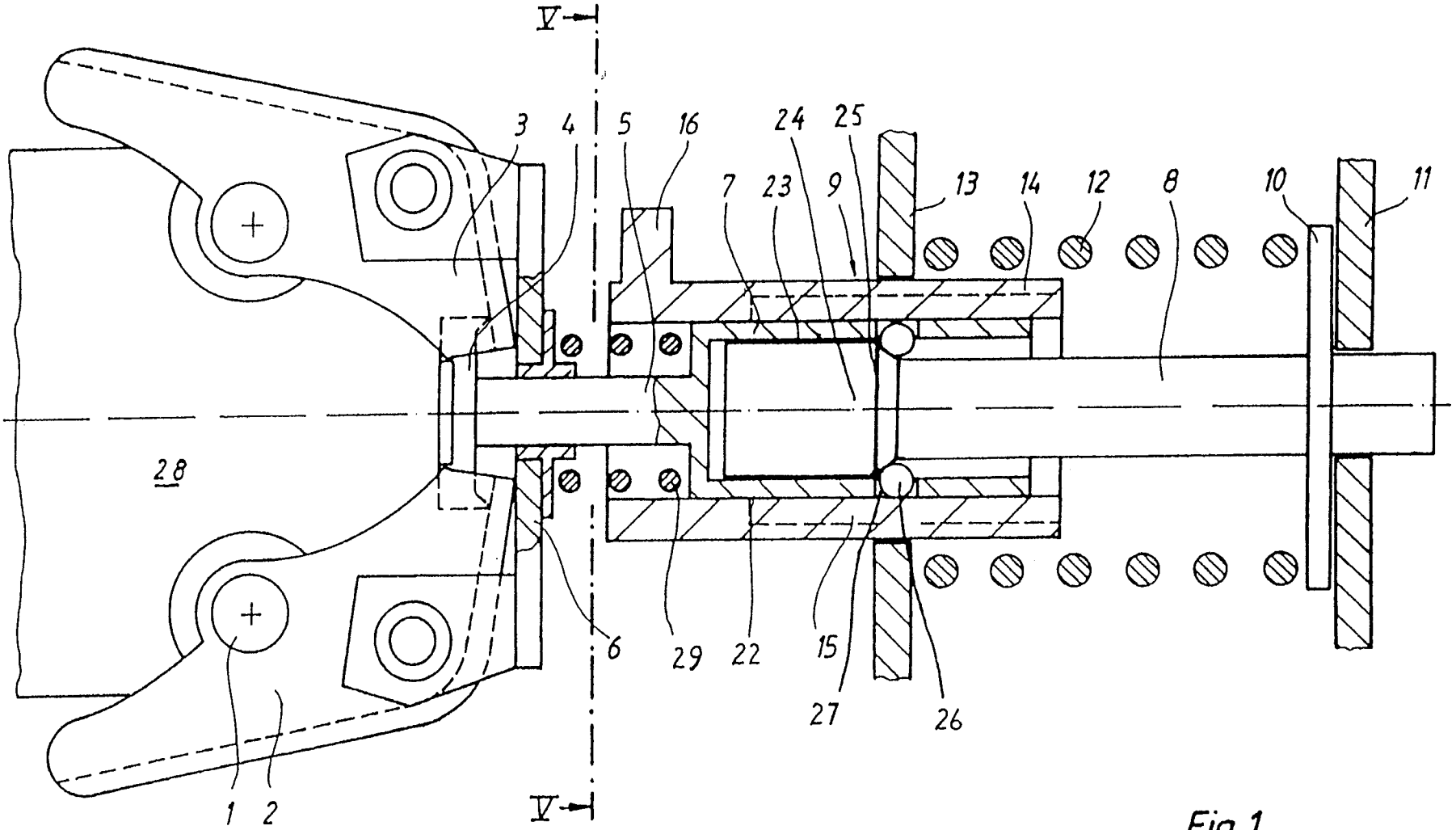
FIG. 1 is a schematic cross-sectional view taken along the line I—I in FIG. 5 of a binding embodying the invention, FIGS. 2 to 4 schematically illustrate the coupling in various positions.

The binding has two holding members 2 pivotal about housing-fixed axles 1 and serve as sole holders and are L-shaped in design. They have an essentially L-shaped cross section and grip with a leg section which extends essentially parallel with respect to the surface of the ski over the sole of a ski boot.

A pressure plate 4 grips over a shorter leg 3 of each of the sole holders 2. The pressure plate 4 is arranged on an end of a two-part pull rod 5 serving as a holding part.

The pull rod 5 extends through a wall 6 of the jaw housing, which wall 6 extends essentially perpendicularly with respect to the upper surface of the ski and the longitudinal extent of the ski, and is movably supported in the housing.

The pull rod 5 is composed of two parts 7 and 8 connected by a coupling 9.

The part 8 of the two-part pull rod 5 has a collar 10 and is axially movably guided in a bore of a further wall 11 of the jaw housing, which wall 11 extends essentially perpendicularly with respect to the surface of the ski and perpendicularly with respect to its longitudinal extent.

A spring 12 is supported on the collar 10 of the pull rod 5, or rather its part 8, which spring 12 is further supported on a further wall 13 extending essentially perpendicularly with respect to the surface of the ski and perpendicularly with respect to its longitudinal extent. The spring is constructed as a compression spring.

Figure 2:
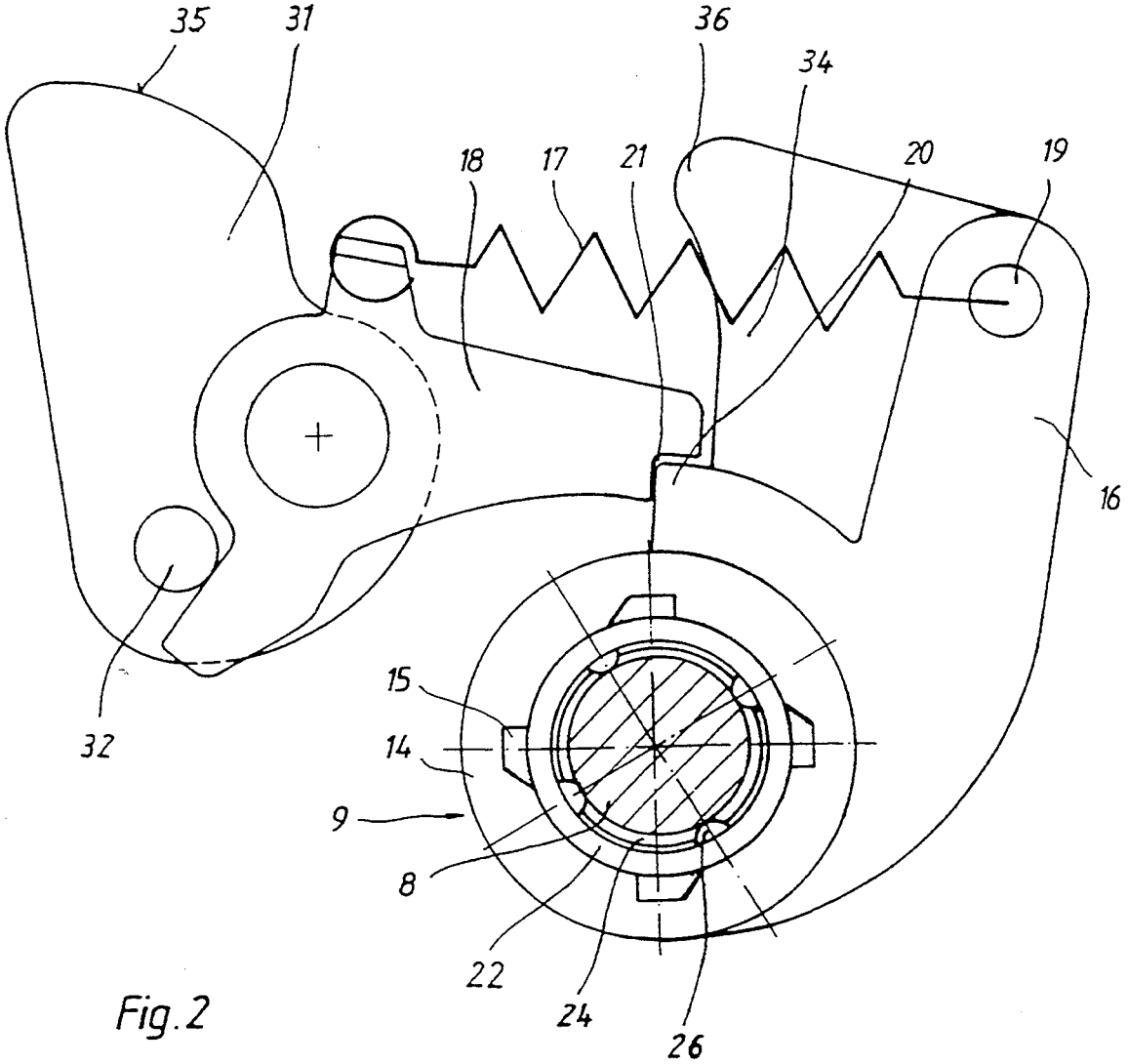
Figure 3:
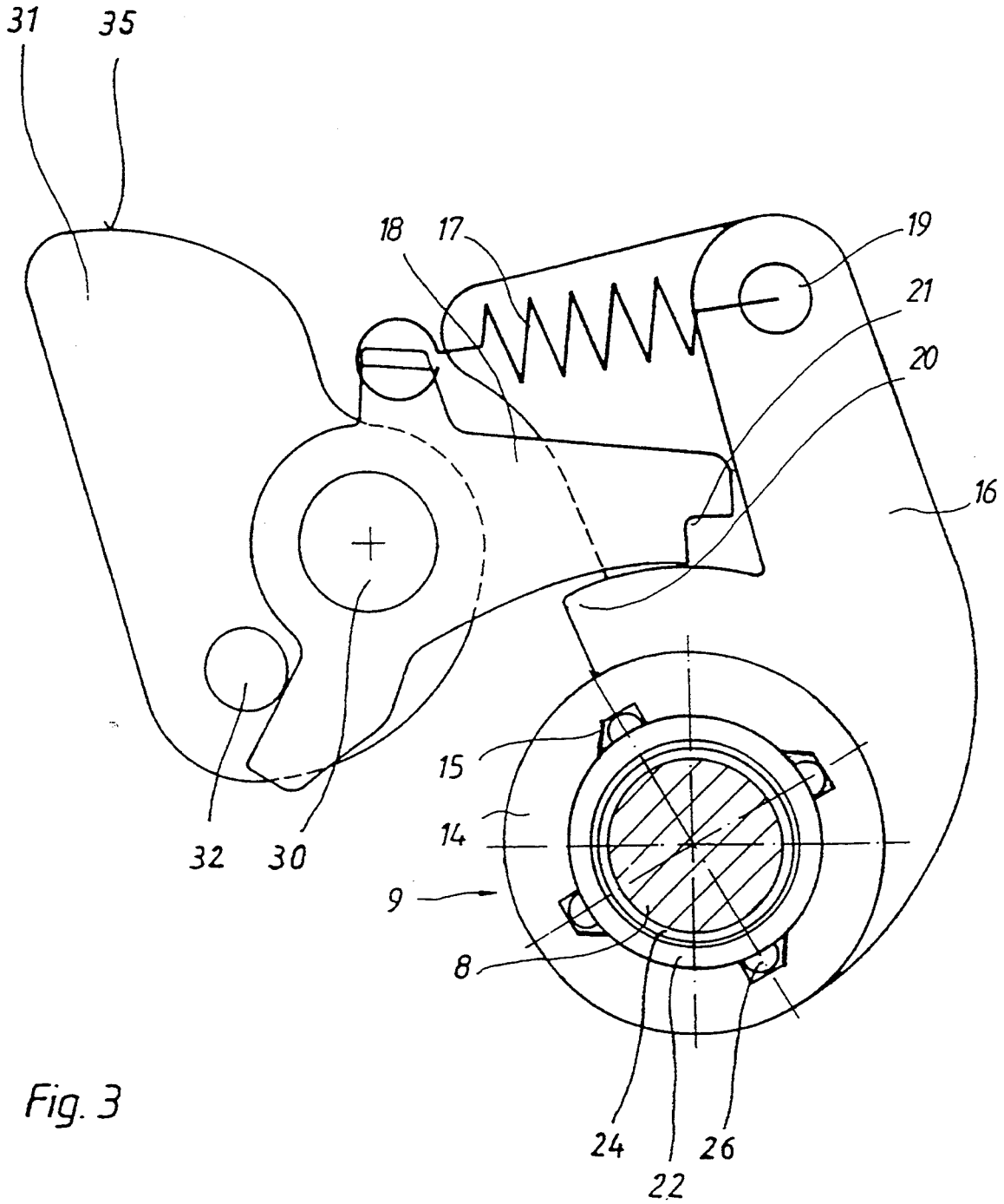
Figure 4:
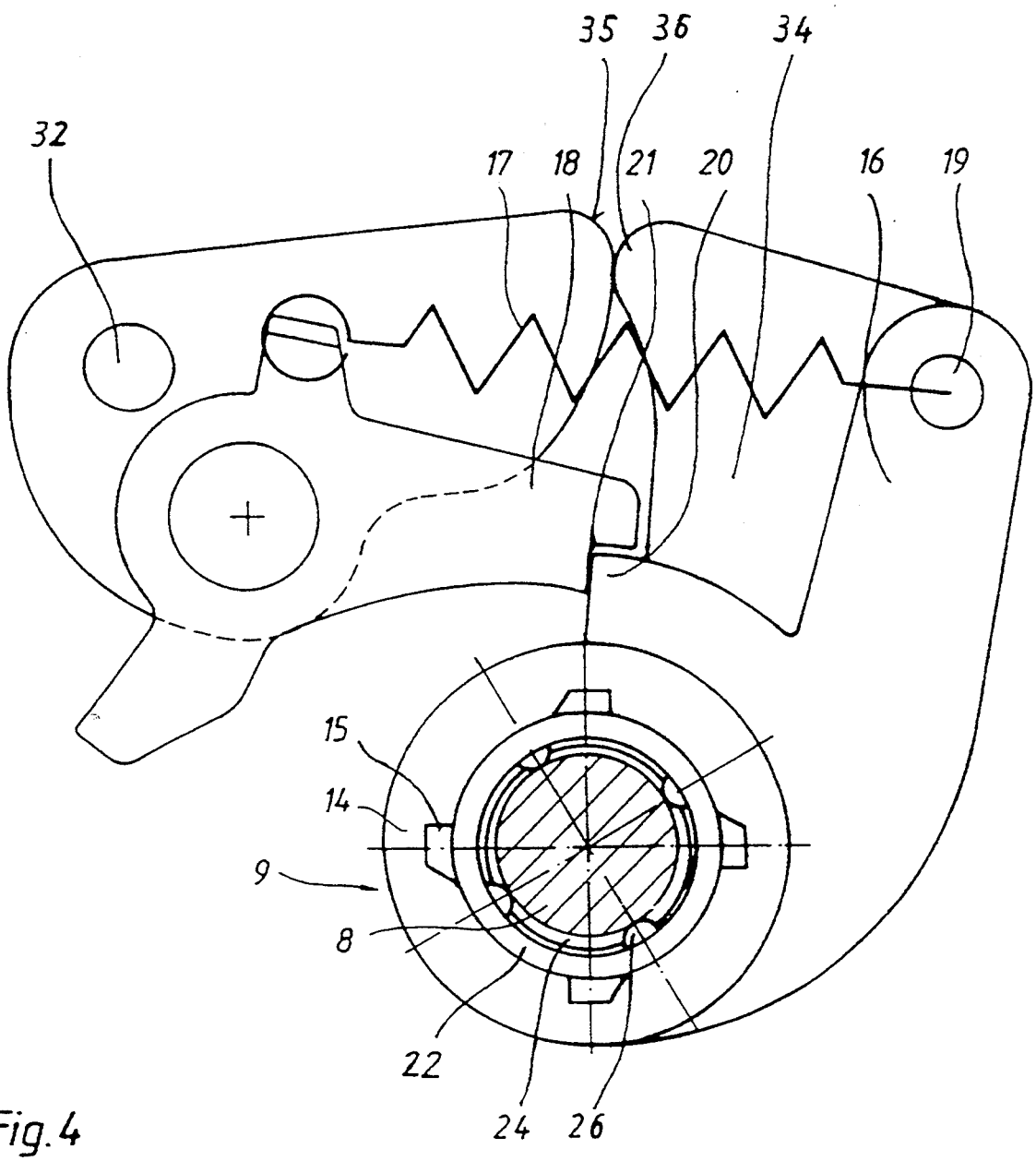

The coupling 9 consists essentially of a sleeve 14, which with clearance extends through the wall 13. The sleeve 14 has, as shown in FIGS. 2 to 4 which show a view of the coupling 9 in direction of the sole holders 2 leaving out the wall 13 and the spring 12, four axially extending grooves 15 in its inner wall. The sleeve 14 has furthermore a cam-like arm 16 which is engaged by a coupling spring 17. One end of the coupling spring 17 extends into a bore 19 in the arm 16. A second end of the spring 17 is suspended in a pawl part 18.

The cam-like arm 16 has a support shoulder 20 cooperating with a corresponding recess 21 on the pawl part 18.

The part 7 of the two-part pull rod 5 is received in the sleeve 14 and has a section 22 constructed as a head, which section has a bore 23 open at its free end. The head 22 is thereby guided with little clearance in the sleeve 14 and is supported for axial movement in the sleeve.

The second part 8 of the two-part pull rod 5 extends into the bore 23, which part 8 also has a section 24 constructed as a head which transfers through a conically tapered outer surface 25 into the remaining area of the part 8. Coupling members 26 rest on this conical outer surface 25 of the part 8, which coupling members are designed as balls guided in radial bores 27 of the head 22. The position of the bores 27 is thereby fixed by the pressure plate 4, which is fixedly connected to the part 7 so as to prevent relative rotation therebetween and which has an essentially rectangular shape and can slide along a base plate 28. A rotation of the pressure plate 4 and thus of the part 7 is thereby prevented.

The grooves 15 in the sleeve 14 are pivoted in the position of the coupling 9 illustrated in FIG. 1, as this is shown in FIG. 2, with respect to the radial bores 27 in the head 22, which bores 27 movably hold the coupling members 26 so that the coupling members cannot give way radially outwardly to overlap the conical outer surface 25 of the head 24 of the part 8. This results in a connection through the coupling members between the two parts 7 and 8 of the two-part pull rod 5, which connection enables a transfer of the pulling forces.

A pivoting of the two sole holders 2 is therefore only possible by overcoming the force of the spring 12.

Whereas if the sleeve 14 is moved into the position shown in FIG. 3 by rotating, then its grooves 15 coincide with the bores 27 of the head 22. Thus, it is possible to urge the coupling members 26 radially outwardly through the conical outer surface 25 on the head 24 of the part 8, thus releasing the positive lock and making a transfer of the pulling forces through the coupling 9 practically no longer possible. Only the force of a relatively weak return spring 29 must in this case be overcome for the pivoting of the sole holder 2, which return spring 29 is supported on the shoulder of the head 22 and on the wall 6. The return spring 29 is designed as a compression spring.

Figure 5:
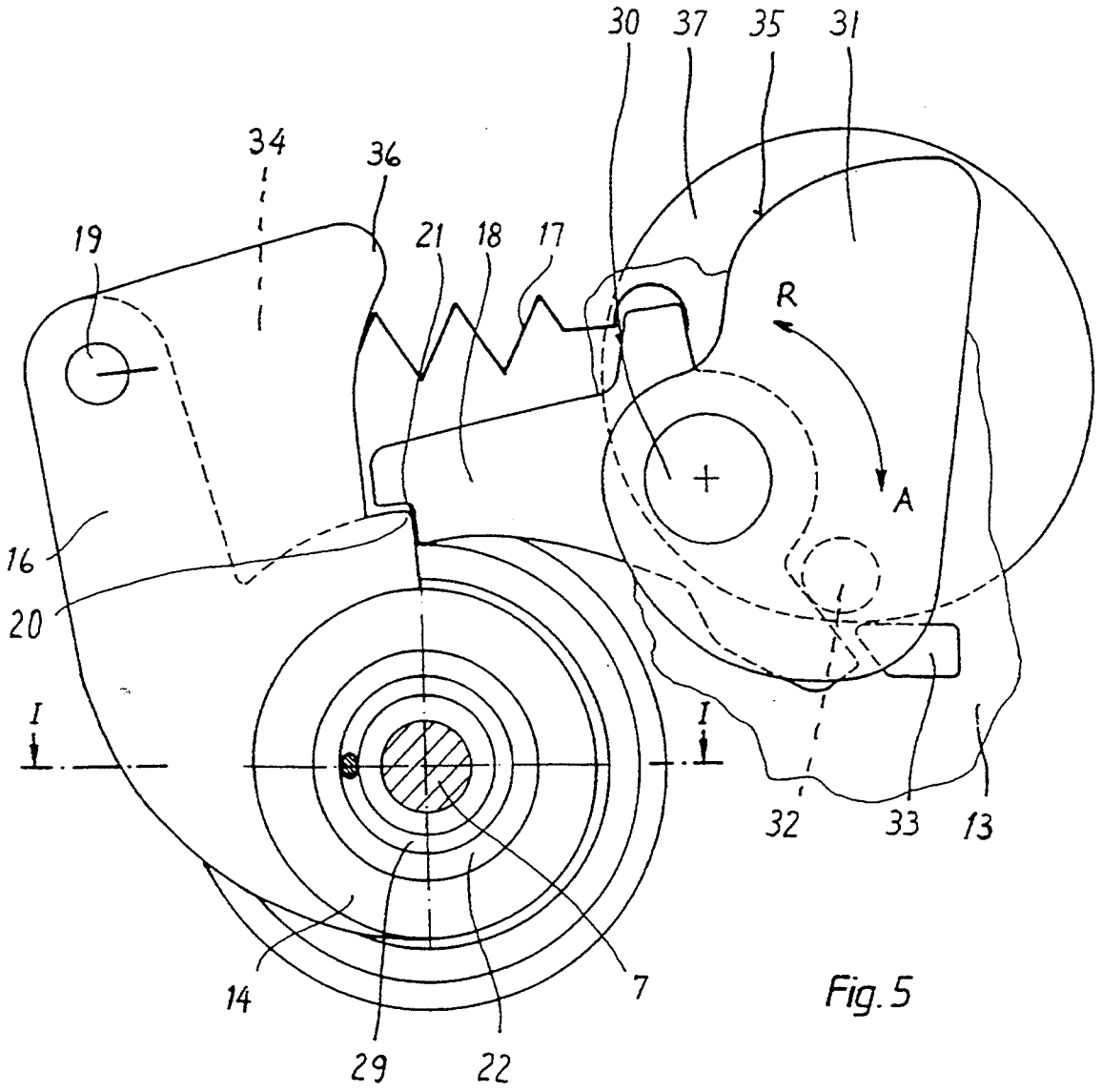
FIG. 5 is a cross-sectional view taken along the line V—V of FIG. 1.

The control of the coupling 9 can be seen better from FIG. 5.

The pawl member 18 is arranged loosely rotatably on a drive shaft 30 which extends through the wall 13. The electric motor 37 driving the drive shaft 30 is provided between the walls 13 and 11 of the housing and has an attached gearing.

A transfer member or element 31 is held fixed against relative rotation to the drive shaft 30. This transfer member 31 has a cam 32 cooperating with the pawl part 18 and is essentially L-shape in design. The cam 32 of the transfer element 31 rests in the rest position of the coupling illustrated in FIGS. 5 and 2, which rest position corresponds with the normal state of the binding, on the shorter leg of the pawl part 18.

By slightly rotating the transfer element 31 in direction of the arrow A, the pawl part 18 is pivoted from a position where its shorter leg rests against a stop 33 of the wall 13 to a position spaced from the stop 33 to terminate the support of the cam-like arm 16 on the support shoulder 20. Since the pawl part 18 rests already with its shorter leg on the stop 33 of the wall 13, a very short path of movement by the transfer element is required so that practically only the arm 16 and thus the sleeve 14 are rotated. The grooves 15, as shown in FIG. 3, thus rest coincident with the radial bores 27 in the head 22 and the coupling members 26 can therefore give way radially outwardly as soon as a pulling force is introduced into the two-part pull rod 5. A pivoting of the sole holder 2 is thus, however, already possible when the force of the return spring 29 has been overcome so that the jaw can no longer absorb any significant forces and effect a release of the ski boot.

When the pawl part 18 is released, namely, when same makes contact in direction of the arrow A, the longer leg of the pawl part 18 slides into a lateral free area 34 in the arm 16, in the area of which this arm has a lesser thickness (FIG. 3).

To return the coupling after such a release operation, the drive shaft 30 is rotated in direction of the arrow R to cause the control edge 35 of the transfer element 31 to engage the cam surface 36 of the arm 16 to turn same back together with the sleeve 14 until the position illustrated in FIG. 4 has been reached and the support shoulder 20 of the arm 16 engages the pawl part 18 caused by the urging of the coupling spring 17. The electric motor 37 turns thereafter the drive shaft 30 and thus the transfer element 31 back into the position shown in FIG. 2 whereat the cam 32 rests on the pawl member 18 or with only a very small gap remaining between same and the cam 32 in order to be able to release the pawl part 18 already only after a short path of movement.

The electric motor 37 can be controlled by suitable position feelers which, for example, detect the position of the transfer element 31 and thus the drive shaft 30 to change the direction of rotation of the electric motor 37 as soon as it, after receiving a release signal, which in a conventional manner is produced by an evaluating circuit processing signals from a force-receiving means, has covered a distance sufficient for a release in the release direction (arrow A). The evaluating circuit can be designed, for example, according to DE-OS 25 19 544. The release signal, which is actually made available only for a very short period of time by such an evaluating circuit, can thereby be kept alive for a sufficiently long time, for example 20 seconds, by means of a monostable multi-vibrator circuit. A further change of the direction of rotation occurs after the position of the transfer element 31, or rather of the drive shaft 30, which position is shown in FIG. 4, has been reached. After the rest position, which is shown in FIG. 2 and in which the cam 32 is very close to the shorter leg of the pawl part 18 or rests on same, has been reached, the electric motor is stopped.

A monitoring of the position of the drive shaft 30 or of the transfer element 31 can, however, also be done without position feelers. The electric motor 37 can be designed as a stepping motor which is controlled by a control circuit and can be triggered by a release signal and which determines the above-mentioned sequence in the form of specific numbers of steps in one direction and also in the other direction.

In both cases it is possible for the release to occur very quickly based on the small distance which the drive shaft 30 must cover for this task, with the relatively strong coupling spring 17 taking care of a quick rotation of the sleeve 14 also under difficult conditions, for example in the case of an accumulation of ice. A return of the binding into the state ready for use following the release task can be slow since after a fall of a skier a time span of approximately 20 to 30 seconds must be expected until the skier is able again to reenter the binding. Since a lengthening of the coupling spring 17 during the return of the sleeve 14 can be done at a very slow speed, between the time of a fall coupled with a release of the binding until the entry into the binding will at any rate take at least 30 seconds, the electric motor needs to produce only a correspondingly low output so that it can be of a small construction.

The embodiments of the invention in which an exclusive property or privilege is claimed are defined as follows:

1. A safety ski binding release and reset mechanism, comprising: a housing, a releasable jaw mechanism mounted on said housing and having at least one sole holding member movable between a ski boot holding position and a ski boot releasing position and for releasably engaging a ski boot when in said ski boot holding position, a first spring provided on said housing, said sole holding member being retained in said ski boot holding position by a two-part holding device, a first part of said two-part holding device being movable against an urging of said first spring which determines a holding force for holding the ski boot in said ski boot holding position, a second part of said two-part holding device engaging said at least one sole holding member, said first and second parts being releasably connected with one another at least in a direction of an action of a force of said first spring by a rotatable coupling mechanism rotated to a first position, said rotatable coupling mechanism including a reversible electric motor for effecting a rotation of said rotatable coupling mechanism between said first position and a second position, and a release of the connection between said first and second parts i response to a movement of said rotatable coupling mechanism to said second position caused by a movement of an output member of said electric motor to a third position, said rotatable coupling mechanism including an initially tensioned second spring for initially urging said rotatable coupling mechanism to said first position to prevent said rotatable coupling mechanism from shifting involuntarily toward said second position to cause said first and second parts to become uncoupled, said output member of said electric motor, when in said third position thereof, causing said first spring to be rendered ineffective thereby reducing a force required to move said at least one sole holding member to said ski boot releasing position.

2. The safety ski binding release and reset mechanism according to claim 1, wherein said rotatable coupling mechanism includes an elongated and rotatably supported hollow sleeve, wherein said first and second parts have overlapping sections arranged coaxially to one another and inside of said sleeve, said sleeve including a longitudinally extending free area on an inside surface thereof, wherein at least one coupling member is provided between said overlapping parts, said second part of said overlapping parts having an inclined surface in a first area oriented between first and second diameter sections and said first part of said overlapping parts having a hole in a second area, wherein said at least one coupling member is received in said hole and has a size which corresponds with the size of the hole, wherein a rotation of said sleeve to said second position will bring said hole and said free area into alignment to enable said control member to enter said free area to effect an uncoupling of said first and second parts, said second spring being coupled at one end to a periphery of said sleeve and extending substantially perpendicularly to a longitudinal axis of said sleeve and tangentially relative to an outer surface of said sleeve and connected at an opposite end to a pivotally supported pawl part operatively engaging said sleeve so as to prevent a movement of said sleeve relative to said first part, said output member in said third position having caused said pawl part under the urging of said second spring to pivot to become disengaged with said sleeve to bring said hole and said free area into alignment.

3. The safety ski binding release and reset mechanism according to claim 2, wherein said output member of said electric motor is a transfer element mounted on and movable with an output shaft of said electric motor.

4. The safety ski binding release and reset mechanism according to claim 3, wherein said transfer element and said pawl part are both movable about an axis of rotation of said output shaft of said electric motor and wherein said pawl part is pivotally supported on and relative to said output shaft.

5. The safety ski binding release and reset mechanism according to claim 3, wherein said sleeve includes a support shoulder extending outwardly therefrom, wherein said pawl part is substantially L-shaped, a first leg of said L-shaped pawl part operatively engaging an arm on said sleeve, a second leg of said pawl part being operatively engaged by an eccentric cam on said transfer element to cause said L-shaped pawl part to pivot relative to said sleeve to effect a disengagement of said first leg and said support shoulder thereby causing said initially tensioned second spring to initiate a rotation of said sleeve.

6. The safety ski binding release and reset mechanism according to claim 5, wherein said transfer element is a plate-like member having a control edge, and wherein said sleeve has an arm extending outwardly therefrom with a cam surface facing said control edge, a rotation of said transfer element in a first direction bringing said control edge and said cam surface into engagement to rotate said sleeve to cause said hole and said free area to become unaligned and said second spring retensioned as said support shoulder and said first leg reengage causing said coupling member to effect a reconnecting of said first and second parts to thereby reset the ski binding.

7. The safety ski binding release and reset mechanism according to claim 3, wherein said force of said second spring is less than said force of said first spring.

8. A safety ski binding release and reset mechanism, comprising: a housing, a releasable jaw mechanism mounted on said housing and having at least one sole holding member movable between a ski boot holding position and a ski boot releasing position and for releasably engaging a ski boot when in said ski boot holding position, a first spring provided on said housing, said sole holding member first retained in said ski boot holding position by a two-part holding device, a first part of said two-part holding device being movable against an urging of said first spring which determines a holding force for holding the ski boot in said ski boot holding position, a second part of said two-part holding device engaging said at least one sole holding member, said first and second parts being releasably connected with one another at least in a direction of an action of a force of said first spring by a rotatable coupling mechanism, said rotatable coupling mechanism including a rotatable responsive means coupled to a reversible electric motor for effecting a release of the connection between said first and second parts in response to a movement of an output member of an electric motor to a first position, a second spring for initially urging said at least one sole holder to said ski boot holding position to prevent said at least one sole holding member from shifting involuntarily to said ski boot releasing position, said output member of said electric motor, when in said first position, causing said first spring to be rendered ineffective thereby reducing a force required to move said at least one sole holding member to said ski boot releasing position to a force determined by said second spring.

* * * * *

UNITED STATES PATENT AND TRADEMARK OFFICE

CERTIFICATE OF CORRECTION

PATENT NO. : 5,338,052

DATED : August 16, 1994

INVENTOR(S) : Henry Freisinger, et al

It is certified that error appears in the above-indentified patent and that said Letters Patent is hereby corrected as shown below:

Column 6, line 33; change "part i response" to ---part in response---.

Column 7, line 16; change "motor and" to ---motor, and---.

Column 8, line 14; change "member first retained" to ---member being retained---.

Signed and Sealed this

Twenty-ninth Day of November, 1994

*Attest:*

*Attesting Officer*

BRUCE LEHMAN

*Commissioner of Patents and Trademarks*